United States Patent [19]

Roberts

[11] 3,939,499

[45] Feb. 24, 1976

[54] RECIRCULATING ELECTROLYTIC TOILET

[75] Inventor: George C. Roberts, Venice, Calif.

[73] Assignee: Monogram Industries, Inc., Santa Monica, Calif.

[22] Filed: July 22, 1974

(Under Rule 47)

[21] Appl. No.: 490,347

Related U.S. Application Data

[63] Continuation-in-part of Ser. No. 286,593, Sept. 5, 1972, abandoned.

[52] U.S. Cl. ..... 4/10; 4/115; 204/149; 210/62; 210/192

[51] Int. Cl.[2] ..... E03D 5/00; A61L 11/00

[58] Field of Search ..... 4/1, 8, 10, 18, 100, 115, 4/118, 131, DIG. 3; 21/102 R; 204/149, 239, 274; 210/62, 167, 192

[56] References Cited

UNITED STATES PATENTS

| | | | |
|---|---|---|---|
| 2,194,781 | 3/1940 | Andrus | 204/149 |
| 2,773,825 | 12/1956 | Newcombe | 204/274 X |
| 3,563,879 | 2/1971 | Richards | 204/149 X |
| 3,568,215 | 3/1971 | Riedel et al. | 4/10 |
| 3,582,485 | 6/1971 | Guter | 204/149 |
| 3,706,646 | 12/1973 | Gibson | 204/149 |
| 3,734,291 | 5/1973 | Schondelmyer | 4/10 |
| 3,755,827 | 9/1973 | Riedel et al. | 4/10 |
| 3,816,073 | 6/1974 | Miller | 4/131 X |
| 3,856,642 | 12/1974 | Lieb et al. | 204/149 |

*Primary Examiner*—Richard E. Aegerter
*Assistant Examiner*—Stuart S. Levy
*Attorney, Agent, or Firm*—Poms, Smith, Lande & Glenny

[57] ABSTRACT

An electrolysis unit is used in conjunction with the holding tank of a self-contained recirculating toilet system. The liquid and solid waster material is macerated and recirculated by an external macerator pump as a fine slurry. The slurry material from the lowermost portion of the waste tank is treated by electrolysis producing oxygen and chlorine and an odor free water vapor exhaust. The residue from the electrolysis decomposition unit is periodically removed.

16 Claims, 7 Drawing Figures

14
12
10
38
20
22
2
16
2
18
34
28
36
26
30
24
40

38
44
42
FROM HOLDING TANK 18
46
41
40

18
20
22
38
28
34
36
26
30
24

50
52
60
56
54
62
64
58

72
74
70
76
78

RECIRCULATING ELECTROLYTIC TOILET

This application is a continuation in part of application Ser. No. 286,593 filed Sept. 5, 1972, now abandoned.

This invention relates to recirculating toilets and more particularly to a self-contained toilet system in combination with an electrolytic decomposition unit for reducing the volume of waste accumulated in the holding tank.

In the general field of human waste disposal, electrolysis has been used as a method for treating raw sewage. The prior art has shown that sewage treated by electrolysis is sterilized more rapidly and hygenic, odor free, and the electrolytic unit can be packaged in a relatively small size for operating over an extended period of time. An article entitled "Disposal of Sewage Sludge" in "Engineering" Vol. 204 Page 828, of Nov. 24, 1967, presents a summary of the advantages of utilizing electrolysis for treating human waste.

Many attempts have been made to incorporate the advantages of utilizing electrolysis in combination with a toilet system so as to provide a compact self-contained sewage treatment system. Systems of this type are exemplified by recently issued U.S. Pat. No. 3,568,215, for a Toilet and Sewage Treatment Apparatus to R. Riedel, et al. Riedel et al disclose a system for utilizing electrolysis in combination with a recirculating toilet.

The earliest marine toilets did not have holding tanks but rather used through hull connections to pump water from outside the vessel into the toilet bowl and simply flushed the water through the toilet bowl out to the ocean or lake. While these earlier systems were efficient and relatively trouble free, they are in many localities considered illegal in view of the ecological demands for cleaning the environment and the free waterways.

Holding tanks of the type presently used in vehicles such as trailers, mobile homes and aircraft have been incorporated in the present day marine toilets for accepting water from an outside source that is used for flushing the toilet bowl. The resultant liquid and waste solids from the toilet bowl are accumulated in a holding tank. Systems of this type are in wide use today and are simple in operation and relatively efficient. However, they suffer from the obvious defect that the holding tank has a limited storage capabibility and must be periodically drained in some approved location and manner. A vehicle must find a suitable disposal station. Similarly, a boat owner may return to dockside, where the holding tank is pumped into the conventional sewage disposal system.

In recent years, recirculating toilet systems have been developed in which a charge of liquid, in combination with a novel filtering system, allows the user to repetitively use the toilet system up to 80 times before the tank is drained and recharged. Systems of this type do not necessarily need a separate holding tank. A holding tank may be used to hold the accumulated waste when the recirculating toilet system is again charged, thereby having the effect of increasing the useful operating time of the toilet system without requiring service.

Typical recirculating toilet systems have been described in U.S. Pats. to W. F. Katona et al, No. 3,356,221; J. W. Dietz et al, No. 3,067,433; and to Kemper, No. 3,567,032.

The prior art fully discloses the theory and operation of electrolysis for treating human waste. The use of highly saline liquid solution has been taught to thereby provide a good electrolyte. A good survey is set forth in Research Paper 2005 of the Division of Research of the Ontario Water Resources Commission dated May, 1967. Raw sewage is mixed in a ratio of approximately 1 to 4 to electrolyte after the sewage had been passed through a fine disintegrator. The resulting mixture is applied to an electrolytic cell using iron cathodes and graphite anodes, operating at 5 to 6 volts with a current density of 0.6 milliamps per $cm^2$. Hypochlorites which initially formed at the anodes immediately react with ammonia, amino acid residues and dissolved nitrogenous substances in the alkaline sewage, which are then converted to soluble organic chloramines.

The chloramines are effective disinfectants and retain their activity longer than the hypochlorites which are initially formed at the anodes. Oxygen is produced as well as chlorine which reacts with water to form hypochlorite at the anode and is chiefly responsible for the instantaneous removal of objectionable, obnoxious odors.

The art has recognized that the electrode reaction is not directly with the waste matter but rather with the chlorides and in the electrolyte. In other words, it is the mixing of these electrode produced reactants with the sewage which results in the beneficial action. Ideally, this mixing should occur at or near to the electrode surface in order to obtain the benefits of any electrode catalytic effects and the benefits of high concentrations of oxygen and hypochlorite.

For small size units, as disclosed in present invention, it is considered important to obtain the sewage and chloride solution together in the electrolysis cell.

The prior art, as exemplified by the Riedel et al patent, does not isolate the waste and liquid in a preferred electrolysis cell nor are there any means described, be they mechanical or electrical, for producing the comminuted effluent which is considered so necessary in the systems described in the prior art.

According to the present invention, the normal operation of the self-contained recirculating toilet system is not interfered with in any way. A separate holding tank is used to periodically accumulate the waste material from the recirculating toilet system. A macerator pump is connected to the holding tank and periodically grinds the liquid and solid matter in the holding tank into a slurry and recirculates this slurry throughout the holding tank.

In this manner colloidal solution of waste material in slurry form is provided which is considered necessary for proper electrolytic action. In addition, the macerator provides an agitation of the slurry without the need of separate impeller recirculating pumps.

Cooperating with the holding tank is a separate electrolytic decomposition unit comprising an electrolysis cell having a pair of electrodes which are connected to a power source. The slurry level in the holding tank determines the level in the electrolysis cell. In a first embodiment, the macerator pump simply recirculates and macerates the slurry material in the holding tank. In a second embodiment, the macerator pump recirculates the liquid from the electrolysis cell through the holding tank. The recirculating system used in any given design will depend upon the size of the holding tank and the size of the electrolysis cell employed.

Decomposition of the waste material by electrolysis unfortunately results in hydrogen and oxygen being liberated by the actual decomposition of the liquid medium. In order to be operated safely, it is necessary that the electrolysis take place in a selected area where potentially hazardous liberated gases can be effectively discharged to the atmosphere. It is for this reason that the present invention provides a separate electrolysis cell where the electrolytic action takes place.

In order to change the phase of the liquid to a gas, it is necessary to apply thermal energy to the liquid thereby increasing the latent heat of vaporization. This is not generally considered a chemical change but rather merely a change of state and can be achieved simply by the addition of energy into the system. Those prior art systems that control the level of liquid by means of vaporization or change of state of the liquid into a gas, must, by definition, use vast amounts of energy out of proportion to the needs of a portable and simple system for fluid control.

It is recognized however, that during the electrolysis action and the chemical breakdown of liquids close to the anodes and cathodes comprising the electrolysis cell, as a result of the instantaneous high energy concentrations resulting from the electrolysis action, bubbles of vaporized liquid collect on the anode and the cathode. These bubbles are usually reabsorbed into solution.

In the present invention, the use of the macerator pump in macerating the liquid and solid material into a fine slurry and the act of recirculating this slurry continuously during the electrolysis action, provides a means of keeping the finely divided electrolyte in motion in the area of the electrodes. The moving electrolyte continuously agitates against the electrodes and liberates the bubbles of trapped gases attached to the electrodes into the resulting atmosphere, thereby providing an additional means of obtaining fluid level control by the direct conversion of the liquid into a gaseous state, without the need of providing additional energy in the form of heat as is generally used in the prior art.

Accordingly it is an object of the present invention to provide an improved recirculating toilet system combined with an electrolytic decomposition cell to sterilize and deodorize waste products.

It is a further object of the invention to provide an electrolytic chamber with a recirculating system to improve the efficiency of the electrodes at relatively lower power levels.

It is yet another object of the invention to extend the range of operation of self-contained, recirculating toilet systems, so that under conditions of heavy use, frequent servicing can be avoided.

Figure 1:
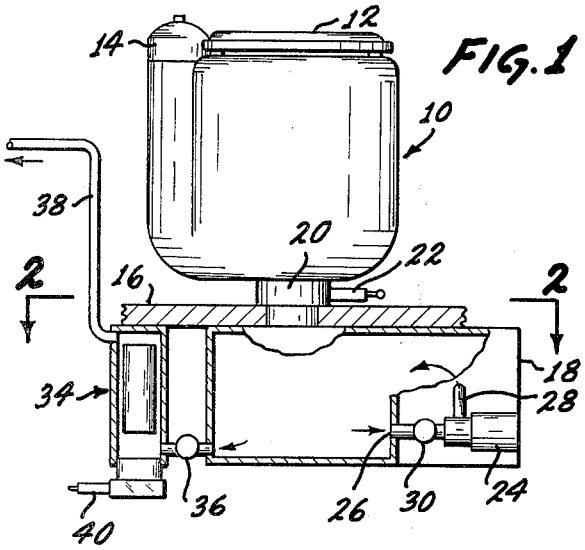
FIG. 1 is a side view of a conventional recirculating toilet adapted for use with the present invention.
Figure 2:
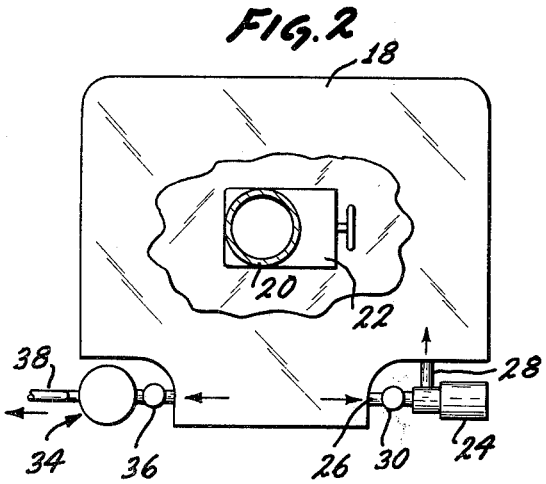
FIG. 2 is a plan view of the holding tank of FIG. 1 taken along the line 2—2 in the direction of the appended arrows.

Referring now to FIGS. 1 and 2, there is shown a complete recirculating toilet 10 of the type described in the above identified patents to Katona and Kemper. The recirculating toilet 10 includes a suitable cover and seat 12 and a cover 14 for access to a pump and filter assembly. The toilet assembly 10 is capable of providing the user with approximately 80 or more flushes and may be considered completely self-contained, in view of the filter pump arrangement which recirculates filtered liquid to flush the toilet.

The recirculating toilet 10 is located on a solid footing 16, which in a vehicle application would represent the "floor" or deck. Located below the footing 16 is a holding tank 18, arranged to communicate with the discharge apparatus 20 of the recirculating toilet 10. A sliding valve 22 controls the opening between the waste discharge apparatus 20 of the recirculating toilet 10 and the holding tank 18. Normally, the recirculating toilet 10 is used independently of the holding tank 18 until it is full, approximately 80 operations. When "full," the sliding valve 22 is opened and the accumulated waste of the recirculating toilet 10 flows into the holding tank 18.

The accumulated waste transferred to the holding tank 18 consists of the original charge of liquid placed within the recirculating toilet, together with any added odor suppressing chemicals and the human liquid and solid waste added through use of the recirculating toilet system 10. In other words, the contents of the holding tank 18 include solid matter, liquid matter and some solid matter in colloidal solution.

Located on one side of the holding tank 18 is a macerator grinding pump 24, similar to the type described and claimed in the patent application of James M. Kemper, Ser. No. 147,810, Combined Pump and Cutting Apparatus, now U.S. Pat. No. 3,722,803, assigned to the assignee of the present invention. The intake to the macerator pump 24 is obtained from the lowermost portion 26 of the holding tank 18 and is returned into the holding tank at a point 28 that is substantially above the normal level of material held within the holding tank. A normally open control valve 30 is located in the intake line to the macerator pump 24 and is closed only when the holding tank or the macerator pump requires service.

The purpose of the macerator grinding pump 24 is to effectively macerate the solid waste liquid materials into a fine slurry to improve the efficiency of the electrolytic action to be described. The prior art, as set forth in an article entitled "Using Sea Water to Purify Sewage," pages No. 1168 to 1169, in the June 24, 1966, edition of Engineering, indicated that electrolysis is very effective in oxidizing concentrated human waste. The products of the electrochemical action are hypochlorites which form at the anode and react with ammonia amino acid residues and dissolved nitrogenous substances to form chloramines which act as disinfectants. Oxygen is also produced at the anode and deodorizes the solution.

The studies used extremely high currents, far in excess of those available for commercial or localized electrolytic sewage treatment systems. These high currents of the order of 50 milliamps $cm^2$ as compared to 0.6 milliamps $cm^2$ achieved a large reduction in the solid material, because of the mixing and turbulance produced at the electrodes by the evolved gases.

In the conventional vehicle application, the high currents or voltages described in the prior art are not readily available to achieve this high reduction in solids. However, the same effect could be produced using a lower current density if the solid waste matter was brought to the vicinity of the electodes in a finely divided or dissolved state. In other words, the macerator pump 24, in macerating the solid and liquid material and providing continuous circulation of this finely divided material during the electrolysis process, provides the necessary agitation of the solution and achieves a vigorous gas evolution, without the need of high current densities. As will be described below, the macerator pump 24 is only operated while an electrolytic decomposition unit 34 is in operation.

Located on the other side of the holding tank 18 is the electrolytic decomposition unit 34 that communicates with the holding tank 18 at the lowermost portion through a normally opened valve 36. The electrolytic decomposition unit 34 is isolated and insulated from the holding tank 18 and contains the necessary spaced apart electrodes for performing the electrolysis action of the slurry. The holding tank 18 may also be insulated, if desired.

A vent 38 communicates the uppermost portion of the decomposition unit 34 to the outside atmosphere for effectively dissipating the gases that are evolved during the electrolysis of the waste slurry. Located on the bottommost portion of the decomposition unit 34 is a slide valve 40 used to cleanse the decomposition unit 34 of waste materials that for one reason or another are not decomposed by electrolysis action. During the cleaning operation, valve 36 would normally be closed and slide valve 40 would be open to thereby purge the decomposition unit 34 of precipitated solids and sediments.

The operation of the system requires that the recirculating toilet 10 be used for the number of flushes available as determined by the initial charge and the cleanliness of the filter of the recirculating toilet. After approximately 80 uses, the slide valve 22 is opened to allow the accumulated liquid and solid wastes to enter the interior of the holding tank 18 after which the slide valve 22 is closed.

With valves 36 and 30 open, the macerator grinder pump 24 and the electrolytic decomposition unit 34 are both turned on for a programmed period of time, calculated to generate a fine slurry of material in colloidal solution, from the liquid and solid waste materials, and to circulate this slurry through the interior of the electrolytic decomposition unit 34. In accordance with the teachings of the present invention, the mixture is subjected to the electrolysis action between the opposing electrodes comprising the decomposition unit 34.

For a holding tank having a capacity of approximately 9 gallons, it is envisioned that operating the decomposition unit 34 and the macerator pump 24 for approximately 30 minutes from a 12-volt battery each time the recirculating toilet 10 is dumped into the holding tank 18, should be sufficient to provide complete sanitation and destruction of the solid matter within the confines of the holding tank.

Figure 3:
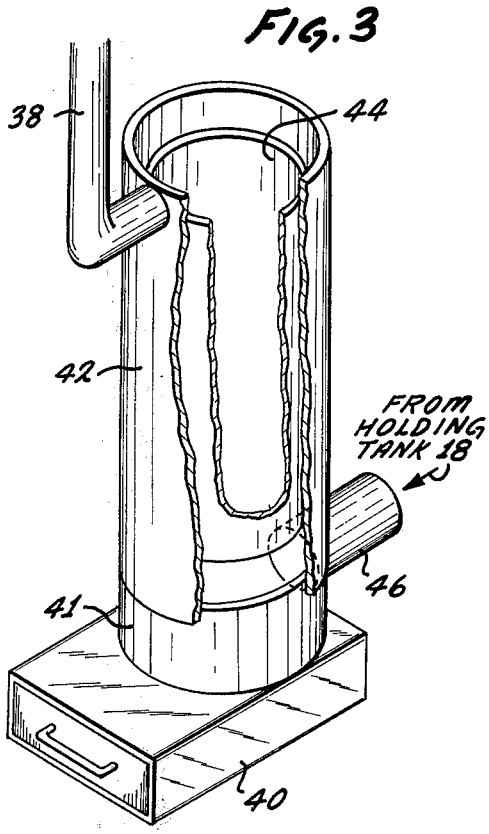
FIG. 3 illustrates a first embodiment of concentric electrolytic decomposition unit.

Turning next to FIG. 3, there is shown a preferred embodiment of the electrolytic decomposition unit 34 comprising a main body portion 41 constructed of an insulated material. Located on the body 41 and in a sealing relationship with the body is a cylindrical outer shell 42, preferably constructed of stainless steel and acting as the anode for the electrolysis action.

Located coaxially and within the outer shell 42, is a smaller cylindrical shell 44, preferably constructed of stainless steel and held in a spaced apart relationship to the outer shell 42. The inner shell 44 may be constructed of a screen, expanded metal or solid material. The associated electrical power source connects to the outer shell 42 and to the inner shell 44, with the liquid circulating therebetween subject to the electrolysis action. The lower, body portion 41 communicates with the holding tank 18 through a suitable pipe inlet 46, which is attached to the normally open valve 36 of FIG. 1. The lower body portion 41 is located upon the slide valve 40 as is shown in FIG. 1.

In operation, the macerator pump 24 is turned on and a voltage is applied between the outer shell 42 and the inner shell 44. The macerating and recirculating action of the macerator pump 24 provides the necessary movement of the fine slurry material between the holding tank 18 and the electrolytic decomposition unit 24. The rapid movement of the slurry material between the inner electrode 44 and the outer electrode 42 also provides the necessary agitation to increase the electrolysis and liberation of the gases, without the need of the high currents usually associated with such devices.

Figure 4:
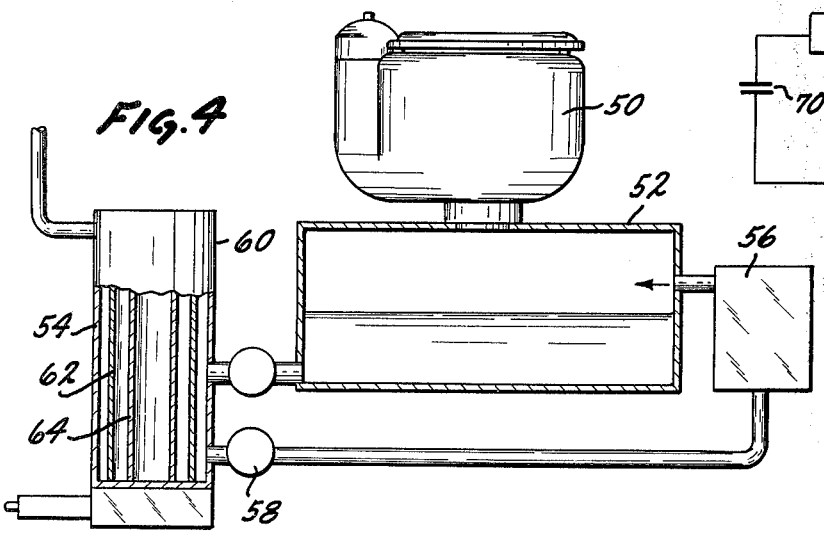
FIG. 4 illustrates a second embodiment of the recirculation system for macerating and recirculating the slurry between a decomposition unit and a holding tank.

In FIG. 4, there is shown a second alternative embodiment of the recirculating system in combination with a modified electrolytic decomposition unit. Experience has indicated that it is sometimes necessary to increase the rapid recirculation of the macerated slurry material between the opposing plates of the electrolytic decomposition unit. Improved operation is possible during a more rapid agitation of the fine slurry.

The system of FIG. 4 includes a recirculating toilet 50 cooperating with a holding tank 52, which provides an opening from the lowermost portion into an electrolytic decomposition unit 54. Macerating and recirculation of the finely divided slurry material is achieved by a macerator pump 56, the inlet of which is the lowermost portion of the electrolytic decomposition unit 54 through a normally open valve 58. The outlet of the macerator pump 56 discharges into the holding tank 52 at a point generally above the highest expected level of slurry liquid.

The overall operation of the system illustrated in FIG. 4 is basically the same as that described in connection with FIG. 1, except however the circulation of the finely divided slurry material through the electrolytic decomposition unit 54 is improved since a separate inlet and outlet are provided which are directly connected to the macerator grinder pump 56. The recirculation system of FIG. 4 insures that the electrodes of the electrolytic decomposition unit 54 are subjected to a varying and highly agitated finely divided slurry for more efficient operation. In addition, the electrolytic decomposition unit 54 is illustrated as a more conventional unit, comprising an insulated outer housing 60 holding a pair of coaxially spaced apart electrodes 62 and 64.

Figure 5:
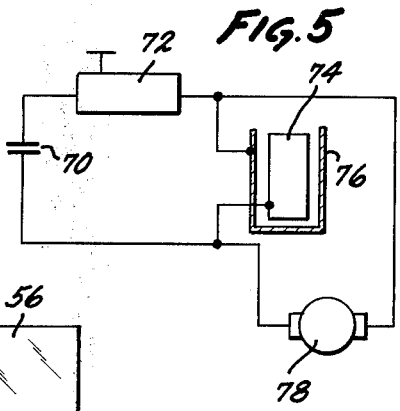
FIG. 5 is a schematic diagram of the electrical connections for operating the electrolysis cell and the macerator grinder pump.

Turning finally to FIG. 5, there is shown a simple electrical schematic of the system. A source of power 70 could be a conventional 12-volt battery or a rectified output from a small a.c. power source. The output of the power source 70 is controlled by a suitable timer 72 of the type that starts a timing motor which operates for a preset period of time. For the application described herein, it is envisioned that for a single recirculating toilet having a 9 gallon capacity, a 12-volt battery used for a time period of approximately 30 minutes, would be effective in reducing the slurry between the opposing electrodes.

This time period is, of course, dependent upon the concentration of the liquid and the kind and size of macerator pump used. Therefore, the actual time which is optimum for a given system may be longer or shorter, depending on the varying parameters of an individual system. The output of the timer 72 is connected across the opposing electrodes 74 and 76 located within the electrolytic decomposition unit and also across the operating connectors of the macerator pump 78.

Activating the timer 72 will therefore allow the electrolysis action to operate for the preset time period, after which both the macerator pump 78 and the electrolysis action will stop.

It will be recognized that for any given system, the time necessary for decomposing and sterilizing the slurry material will depend upon the size of the pipe, the size of the macerator grinder pump, the efficiency of the power source and the cross section current available for the electrolysis action, together with the salinity of the liquid that is subject to the electrolysis. These varying parameters will only effect the time of breakdown and will determine the setting of the timer 72.

Thus, there has been described a novel combination of a recirculating toilet, holding tank and electrolysis decomposition unit, the operation of which is enhanced by a macerator grinder pump. The pump comminutes and circulates waste material and fluid in the holding tank and, through such recirculation, passes the finely divided waste material into the decomposition unit. Because the waste matter is circulating in the decomposition unit, the gases evolving at the electrodes are swept away, thereby assuring a maximum active surface area of the electrodes which permits effective operation at relatively low voltages and currents.

In an alternative embodiment, the outlet of the macerator grinder pump is actually connected to the electrolytic cell so as to circulate the comminuted waste material through the decomposition unit, thereby agitating the electrode surfaces and liberating evolved gases. Since the gases evolved from the electrolysis of the fluid are vented to the exterior, continued operation of the electrolysis unit effectively reduce the volume of fluid maintained in the holding tank.

When contained in a vehicle, the effective range of the vehicle is substantially increased. This increase in range results from the avoidance of the need for frequent draining of the holding tank since the tank will thereby fill more slowly.

Although an electrolysis unit alone may be used in accordance with the teachings of my invention as discussed hereinabove with respect to FIGS. 1 through 4, heating means may be coupled with an electrolytic cell to provide an amplification of efficiency by electrolyzing the mascerated slurry to be heated.

Figure 6:
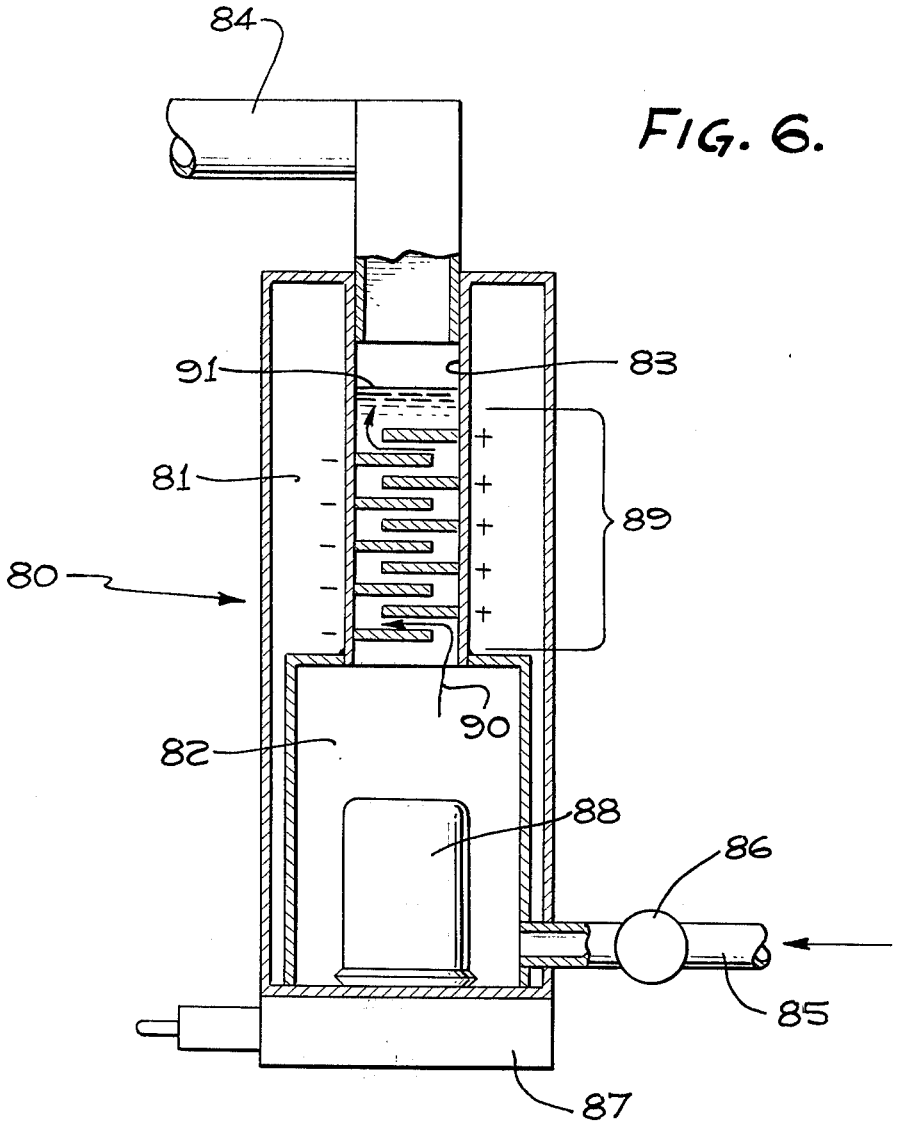
FIG. 6 is a view similar to FIG. 3 showing another embodiment of the decomposition unit.

Thus, as shown in FIG. 6, an electrolytic and evaporation unit 80 may be provided which is adapted to be coupled to either the holding tank 18 of the embodiment of FIG. 1 or the tank 52 and pump 56 of the embodiment of FIG. 4. Unit 80 includes a main body portion 81 which may be constructed of an insulated material, such as a suitable plastic or the like. The interior of body portion 81 may include an inner chamber 82 and a narrower or restricted neck portion 83 communicating with both chamber 82 and a vent 84 as discussed hereinabove with respect to vent 38. The lower portion of body portion 81 communicates with either tank 18 of FIG. 1 or tank 52 and pump 56 of FIG. 4 through a suitable pipe inlet 85, which has associated therewith a normally open valve 86. The lowermost portion of body portion 81 is located upon a slide valve 87, similar to the valve 40 of FIGS. 1 and 4. Heating means, in the preferred form of a heater 88, which heater is of a suitable wattage to apply heat to the solution within unit 80, is disposed internally of body portion 81 within chamber 82 and in the path of the macerated slurry being admitted through inlet 85.

Figure 7:
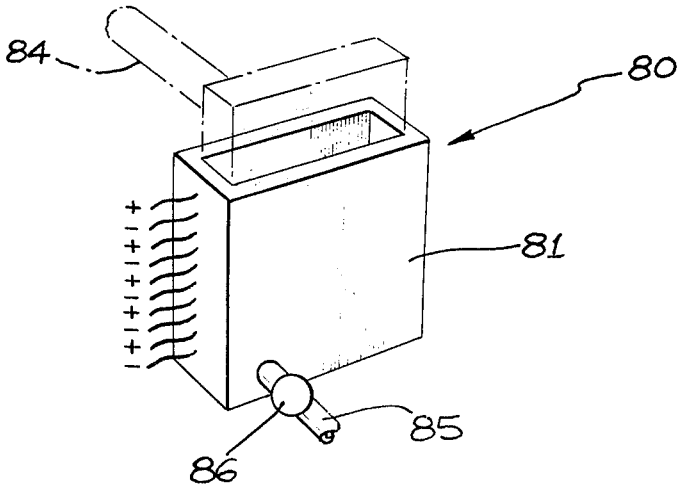
FIG. 7 is a perspective view of the unit of FIG. 6.

Electrolytic decomposition means, in the form of a plurality of staggered spaced electrode plates 89, are disposed internally of body portion 81 within neck portion 83 and thus in the path of the slurry being flowed therethrough. As shown in FIG. 6, the slurry passes between plates 89 as indicated by arrow 90, which plates, as shown in FIG. 7, are connected to a suitable source of electricity converting one of the plates 89 to an anode and an adjacent plate 89 to a cathode, etc.

Thus, in operation, the mascerator pump 24 is turned on and voltage is applied to plates 89 while heater 88, which is also coupled to a suitable source of electricity, is activated. The mascerating and recirculating action of pump 24 provides the necessary movement of the fine slurry material from tank 18 (or tank 52) into unit 80. As discussed hereinabove, chemical breakdown of liquids close to the anodes and cathodes (i.e. plates 89) takes place during the electrolysis action. The electrolysis renders the slurry clarified while the heater 88 evaporates the clarified slurry reducing the liquid portion of the waste volume thus greatly increasing the time between servicing of unit 80 (the liquid therein may rise to a predetermined level, such as level 91, and serviced when necessary).

The combination of electrolysis by means of plates 89 and the evaporation by means of heater 88 results in a synergistic effect in that the boil or evaporation is greatly accelerated and enhanced by electrolysis.

Pre-heating or boiling the slurry prior to electrolyzing it also greatly increases the boiling rate. This may be predicated by the chlorine gas bubbles created by the electrolytic action. Such bubbles may provide nucleation centers for increasing the vaporization or boiling rate.

Another advantage unit 80 has over the embodiments of FIGS. 1 and 4 is that the slurry carries waste paper products in solution. The combination electrolytic-evaporation system of unit 80 digests such paper products. That is, the following reaction takes place in unit 80:

$$2\,Na\,Cl + 2\,HOH \rightarrow 2\,NaOH + Cl_2 + H_2$$

That is, the salt and water in the slurry react to form sodium hydroxide, chlorine and hydrogen, subsequently, the sodium hydroxide (NaOH) dissociates to provide a very basic solution, i.e., a pH of about 9–11. This hot, alkali solution digests the paper products suspended in the solution in unit 80.

It can be seen, therefore, that the electrolytic-evaporation unit 80 renders the slurry clarified and odor-free. The evaporation as generated by the rapid electrolysis of the saline waste solution reduces the volume of collected wastes. It also provides an odor-free water vapor exhaust out of vent 84. The staggered plates 89 present a relatively tortuous path for the solution presenting more exposure to gaseous chlorine as the solution contacts the plates 89. Although a heater 88 disposed internally of the unit 80 has been disclosed, the entire unit 80 may be heated by any suitable means, externally or internally, sufficient to heat the solution conveyed therein. Further, the amount of heat to be provided depends upon the capacity of unit 80 and the degree of evaporation desired. That is, the heat added therein increases the boiling rate and thus the evaporation of the solution.

It is claimed:

1. A self-contained toilet system comprising:

a holding tank in fluid flow communication with a toilet bowl for accepting a mixture of a salt-containing fluid, and solid and liquid waste matter deposited in said bowl;

an electrolytic decomposition unit spaced from and separate from said holding tank and in fluid flow communication therewith, said unit having a pair of spaced electrodes disposed therein, and voltage means operatively connected to each of said electrodes; and macerating and communiting pump means separate from said tank and in fluid communication with both said unit and said holding tank for pumping the mixture of salt-containing fluid and solid and liquid waste matter from said holding tank, macerating and communiting said pumped matter into a fine slurry in colloidal solution and circulating said fine slurry back into said holding tank, then from said holding tank into the interior of said unit in an agitated state and into contact with said electrodes therein until liberated chlorine and oxygen produced by the contact of said slurry with said electrodes react with the remainder of the slurry to clarify said slurry and generate an odor-free effluent therefrom.

2. A system according to claim 1, in which said pump means are connected to the lowermost portion of said holding tank for more thoroughly macerating said liquid and said solid matter.

3. A system according to claim 1 in which said pump means are connected to the lowermost portion of said decomposition unit for more thoroughly macerating said liquid and said solid matter.

4. A system according to claim 1 in which said electrodes are cylindrical and coaxially disposed in a manner forming inner and outer spaced electrodes and in which said outer electrode is a container for holding said slurry.

5. A system according to claim 4 in which said paid of coaxial electrodes are both stainless steel.

6. A system according to claim 4 in which said inner coaxial electrode is a screen mesh for increasing the active surface area of said electrode.

7. A system according to claim 1 in which said holding tank is made of an insulative material.

8. A system according to claim 1 further including timing means coupled to both said pump means and said unit for operating said pump means and energizing said electrolytic decomposition unit for pre-determined timed intervals.

9. A system according to claim 1 further including operating means coupled to both said pump means and said unit for activating said pump means whenever said electrolytic decomposition unit is energized.

10. A system according to claim 9 further including power means coupled to the said operating means for activating said pump means and energizing said electrolytic decomposition unit.

11. A method for reducing the volume of waste matter accumulated in a holding tank in fluid flow communication with a toilet bowl wherein said tank receives a mixture of a salt-containing fluid and solid and liquid waste matter deposited in said bowl, and an electrolytic decomposition unit, spaced from and separate from said holding tank and in fluid flow communication therewith, said unit having a pair of spaced electrodes disposed therein, said method comprising the steps of:

pumping said mixture from said tank;

macerating and communiting said mixture pump from said tank into a fine slurry in colloidal solution;

applying a voltage to each of said electrodes;

circulating said fine slurry back into said tank and through said unit while agitating said fine slurry into contact with spaced electrodes in said unit; and continuing the circulation of said fine slurry into contact with said electrodes until chlorine and oxygen are liberated by the contact of said fine slurry with said electrodes and said liberated chlorine and oxygen reacts with the remainder of said slurry to thereby clarify said slurry and generate an odor-free effluent therefrom.

12. The method of claim 11 including the step of recirculating said clarified slurry back into said tank.

13. A self-contained toilet system comprising:

a holding tank in fluid flow communication with a toilet bowl for accepting a mixture of a salt-containing fluid, and solid and liquid waste matter deposited in said bowl;

an electrolytic decomposition unit spaced from and separate from said holding tank having an interior in fluid flow communication with said tank, said unit having at least a pair of spaced electrodes disposed in the interior therein, voltage means operatively connected to each of said electrodes, and heating means associated with said unit for heating the interior thereof; and macerating and communiting pump means separate from said tank and in fluid communication with both said unit and said holding tank for pumping the mixture of salt-containing fluid and solid and liquid waste matter from said holding tank, macerating and communiting said pumped matter into a fine slurry in collodial solution and circulating said fine flurry back into said holding tank and from said tank into the interior of said unit in an agitated state and into contact with said electrodes therein while heating the interior of said unit until liberated chlorine and oxygen produced by the contact of said slurry with said electrodes react with the remainder of the slurry to clarify and evaporate said slurry and generate an odor-free effluent therefrom.

14. In the system of claim 13 wherein said electrodes includes a plurality of spaced electrodes mounted in the interior of said unit in fluid communication with said slurry, said spaced electrodes being staggered in a manner forming a tortious path through said unit, said path being in fluid flow communication at one end with the slurry entering said unit and at the other end communicating with a vent to the atmosphere.

15. A method for reducing the volume of waste matter accumulated in a holding tank in fluid flow communication with a toilet bowl wherein said tank receives a mixture of a salt-containing fluid and solid and liquid waste matter deposited in said bowl, and an electrolytic decomposition unit spaced from and separate from said holding tank and in fluid flow communication therewith, said unit having at least a pair of spaced electrodes disposed therein and means for heating the interior associated therewith, said method comprising the steps of:

pumping said mixture from said tank;

macerating and communiting said mixture pumped from said tank into a fine slurry in colloidal solution;

applying a voltage to said electrodes;

circulating said fine slurry back into said tank and through said unit into contact with spaced electrodes in said unit;

heating the interior of said unit in fluid communication with said slurry being circulated therethrough; and continuing the circulation of said fine slurry into contact with said electrodes while heating said slurry until chlorine and oxygen are liberated by the contact of said fine slurry with said electrodes and said liberated chlorine and oxygen reacts with the remainder of said slurry to thereby clarify and evaporate said slurry and generate an odor-free effluent therefrom.

16. In the method of claim 15 wherein said electrodes include a plurality of spaced electrodes mounted in the interior of said unit in fluid communication with said slurry, said spaced electrodes being staggered in a manner forming a tortuous path through said unit, said path being in fluid flow communication at one end with the slurry entering said unit and at the other end communicating with a vent to the atmosphere; and the step of circulating said slurry includes the step of circulating said slurry through said tortuous path.

* * * * *